US006385570B1

(12) United States Patent
Kim

(10) Patent No.: US 6,385,570 B1
(45) Date of Patent: May 7, 2002

(54) APPARATUS AND METHOD FOR DETECTING TRANSITIONAL PART OF SPEECH AND METHOD OF SYNTHESIZING TRANSITIONAL PARTS OF SPEECH

(75) Inventor: Moo-young Kim, Seongnam (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/562,887

(22) Filed: May 1, 2000

(30) Foreign Application Priority Data

Nov. 17, 1999 (KR) ..... 99-51065

(51) Int. Cl.[7] ..... G10L 11/00

(52) U.S. Cl. ..... 704/200; 704/208; 704/214; 704/226; 704/258

(58) Field of Search ..... 704/200, 226, 704/227, 228, 214, 208, 258

(56) References Cited

U.S. PATENT DOCUMENTS 5,189,701 A * 2/1993 Jain ..... 381/41
5,241,649 A * 8/1993 Niyada ..... 704/200
5,390,278 A * 2/1995 Gupta et al. ..... 704/243
5,408,581 A * 4/1995 Suzuki et al. ..... 704/226
6,018,706 A * 1/2000 Huang et al. ..... 704/207
6,188,979 B1 * 2/2001 Ashley ..... 704/205
6,324,505 B1 * 11/2001 Choy et al. ..... 704/230

* cited by examiner

*Primary Examiner*—William Korzuch
*Assistant Examiner*—Susan McFadden
(74) *Attorney, Agent, or Firm*—Burns, Doane, Swecker & Mathis, L.L.P.

(57) ABSTRACT

An apparatus and method for detecting transitional parts of speech, and a method of synthesizing transitional parts of speech, are provided. This apparatus includes a residual signal preprocessor for emphasizing a period of a speech residual signal which includes a peak value, a relative peak value calculation unit for obtaining a peak value of a preprocessed residual signal and a relative peak value using a predetermined reference peak value, and a transitional part detector for detecting transitional parts of speech on the basis of the relative peak value.

11 Claims, 4 Drawing Sheets

APPARATUS AND METHOD FOR DETECTING TRANSITIONAL PART OF SPEECH AND METHOD OF SYNTHESIZING TRANSITIONAL PARTS OF SPEECH

The following is based on Korean Patent Application No. 99-51065 filed Nov. 17, 1999, herein incorporated by reference.

BACKGROUND OF THE INVENTION

1. Field of the Invention

The present invention relates to speech signal processing, and more particularly, to an apparatus and method for detecting and synthesizing transitional parts of a speech.

2. Description of the Related Art

Human speech includes stationary parts and transitional parts. For example, the stationary part includes silence, voiced/unvoiced sounds based on existence or non-existence of resonance, or the like, and the transitional part includes plosive sounds, abrupt onset sounds, irregular offset sounds, or the like. Conventional speech coders, particularly, harmonic speech coders, code speech using the harmonic component of pitch in the frequency domain, and use the magnitude information of speech and the probability of speech in each band as essential parameters.

In speech coding, it is idealistic that the magnitude information of speech is used for the stationary part of speech, and the phase information of speech is utilized for the transitional part. However, harmonic speech coders estimate only an accurate spectral magnitude of the stationary part by using only the magnitude information, and cause a deterioration in the quality of sound in transitional parts by not using phase information. Therefore, speech coders require a detection and synthesis algorithm for transitional parts to obtain high quality speech at low bit rates, preferably, at 4 Kbit/s.

In the prior art, an absolute peak value with sliding window is used to detect transitional parts from speech. The absolute peak value (P) is calculated by the following Equation 1:

$$P = \max_{i=-T_s}^{T_s-1} P_i \tag{1}$$

$$P_i = \frac{\sqrt{\frac{1}{N}\sum_{N=0}^{N-1}|r(n+i)|^2}}{\frac{1}{N}\sum_{N=0}^{N-1}|r(n+i)|}$$

wherein $P_i$ denotes a peak value at an i-th sample according to a sliding window, r(n) denotes a linear predictive coding (LPC) residual signal, N denotes the size of a subframe, and $T_s$ denotes the maximum sliding range. A transitional part flag is set when the absolute peak value (P) is greater than a threshold value.

FIGS. 1 and 2 show examples of detection of transitional parts of speech according to a conventional method. FIG. 1(*a*) shows a speech signal in a clean environment, and FIG. 2(*a*) shows a speech signal in a noisy environment. FIGS. 1(*b*) and 2(*b*) show an absolute peak value in a clean environment and in a noisy environment, respectively. FIGS. 1(*c*) and 2(*c*) show results of detection of transitional parts in a clean environment and in a noisy environment, respectively. In FIG. 1, transitional parts were detected using the absolute peak value, but in FIG. 2, transitional parts were not detected. That is, in the prior art, results of detection of transitional parts in the noisy environment are not good.

When an absolute peak value is increased, the detection rate is increased, and the false alarm rate is also relatively increased. Conversely, when the absolute peak value is decreased, the false alarm rate is decreased, and the detection rate is also relatively decreased. Therefore, the conventional method has a limit in that the detection rate and the false alarm rate depend on the absolute peak value.

SUMMARY OF THE INVENTION

An objective of the present invention is to provide an apparatus for detecting transitional parts of speech, by which the detection rate of transitional parts of speech in a noisy environment can be improved, and high quality speech at low bit rates can be eventually obtained.

Another objective of the present invention is to provide a transitional speech detecting method which is performed by the apparatus.

Still another objective of the present invention is to provide a method of effectively synthesizing detected transitional parts of a speech.

To achieve the first objective of the invention, there is provided an apparatus for detecting transitional parts of speech, including: a residual signal preprocessor for emphasizing a period of a speech residual signal which includes a peak value; a relative peak value calculation unit for obtaining a peak value of a preprocessed residual signal and a relative peak value using a predetermined reference peak value; and a transitional part detector for detecting transitional parts of speech on the basis of the relative peak value.

To achieve the second objective of the invention, there is provided a method of detecting transitional parts of speech, comprising: (a) preprocessing a residual signal by emphasizing a period of a speech residual signal which includes a peak value; (b) obtaining the peak value of a preprocessed residual signal; (c) obtaining a relative peak value with respect to the peak signal of the preprocessed residual signal using a predetermined reference peak value; and (d) determining whether transitional parts exist or do not exist, on the basis of the relative peak value.

To achieve the third objective of the invention, there is provided a method of synthesizing transitional parts of speech, including: (a) determining which harmonic, among harmonic components of a pitch, phase information is to be allocated to, when speech is expressed in the frequency domain; (b) allocating the start position of a transitional part and phase information obtained from a phase at the start position, to a harmonic to which phase information is important; and (c) synthesizing corresponding transitional parts using the allocated phase information.

BRIEF DESCRIPTION OF THE DRAWINGS

The above objectives and advantages of the present invention will become more apparent by describing in detail a preferred embodiment thereof with reference to the attached drawings in which.

DESCRIPTION OF THE PREFERRED EMBODIMENT

The present invention is characterized in that a relative peak value is used to detect transitional parts of speech, so that it is robust against a noise background, and that a precise start position of a transitional part can be detected.

Figure 1:
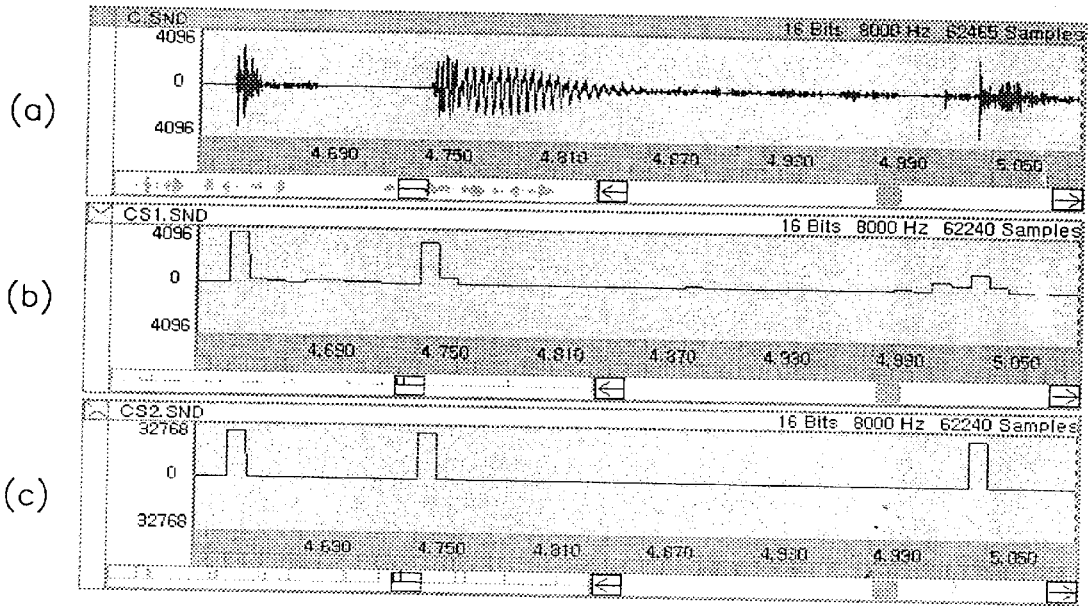
FIG. 1 (PRIOR ART)
FIGS. 1 and 2 illustrate examples of detection of transitional parts of speech according to a conventional method.
Figure 2:
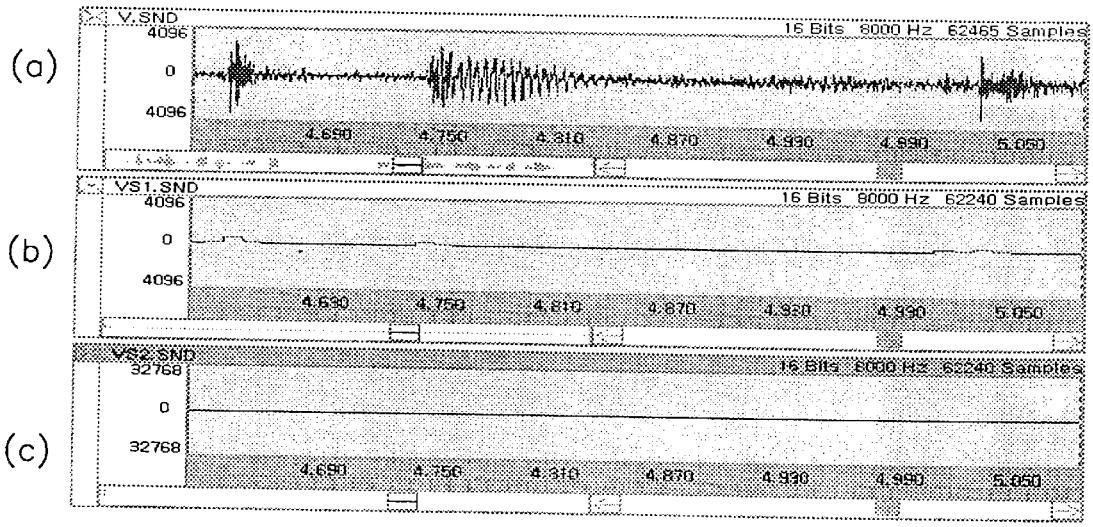
FIG. 2 (PRIOR ART)
Figure 3:
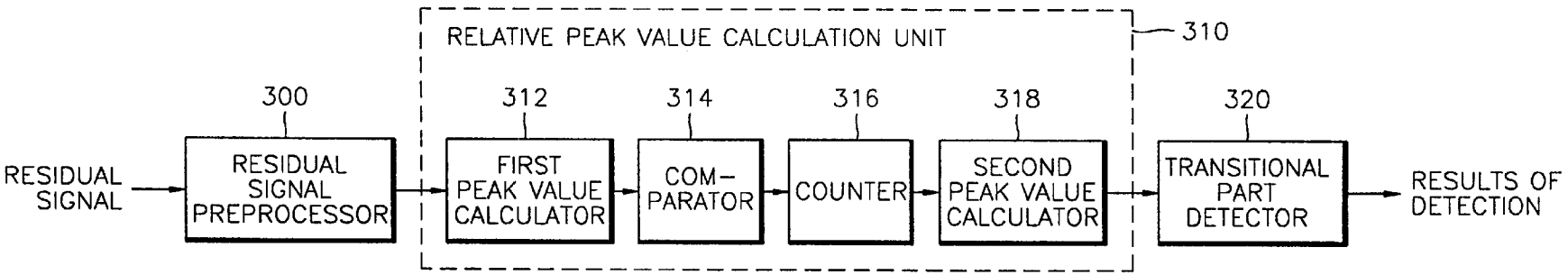
FIG. 3 is a block diagram of an apparatus for detecting transitional parts of speech, according to the present invention.

Referring to FIG. 3, which is a block diagram an apparatus for detecting transitional parts of speech according to the present invention, the apparatus includes a residual signal preprocessor 300, a relative peak value calculation unit 310, and a transitional part detector 320. The relative peak value calculation unit 310 includes a first peak value calculator 312, a comparator 314, a counter 316 and a second peak value calculator 318.

Figure 4:
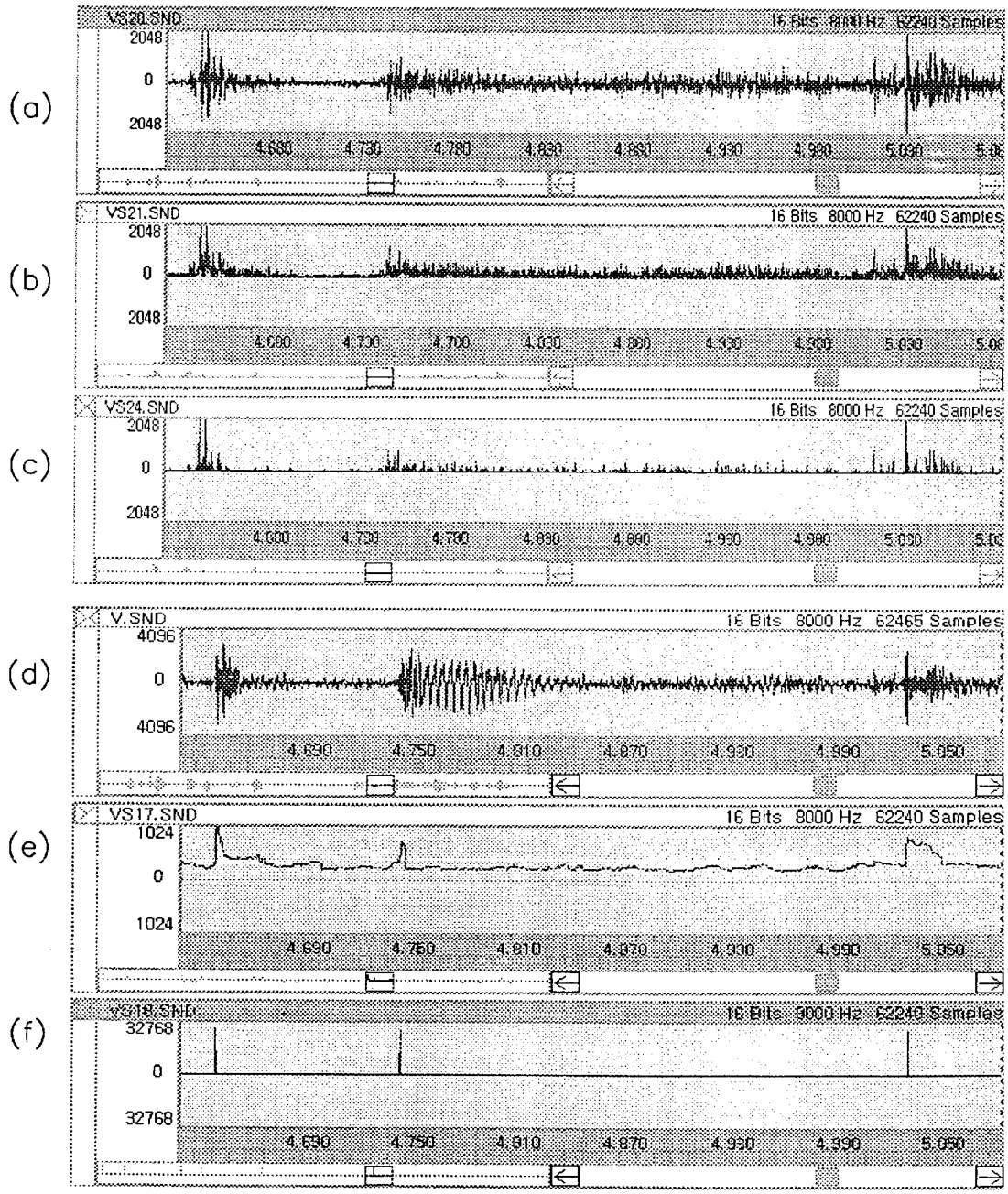
FIG. 4 illustrates experiments according to a method of detecting transitional parts of speech, according to the present invention.

FIG. 4 illustrates experiments according to a method of detecting transitional parts of speech, according to the present invention. The operation of the apparatus shown in FIG. 3 will now be described in detail with reference to FIG. 4.

Speech coders based on standardization generally express a speech signal as a spectral envelope signal and a spectral residual signal. A linear predictive coding (LPC) coefficient is extracted from the speech signal, and an LPC residual signal is obtained using the LPC coefficient. In FIG. 4, (d) shows a speech signal S(n), and (a) shows an LPC residual signal r(n).

In FIG. 3, the residual signal preprocessor 300 performs preprocessing such as signal rectification, DC removal, and center clipping, for emphasizing a period including a peak value, before obtaining the peak value of the LPC residual signal.

To be more specific, the difference r'(n) between the absolute value of a residual signal r(n) and the average value $\bar{r}$ thereof is obtained. The average value $\bar{r}$ of the residual signal is an average value in an arbitrary signal period. Then, if the difference r'(n) is greater than a predetermined reference value $r_{th}$, the difference r'(n) is used, and otherwise, the difference r'(n) is set to a value of 0. Consequently, a peak-emphasized residual signal $\tilde{r}$(n)is obtained. This process can be expressed by the following Equation 2:

$$r'(n) = |r(n)| - \bar{r}, \quad n = 0, 1, \ldots, N-1 \tag{2}$$

$$\bar{r} = \frac{1}{N}\sum_{n=0}^{N-1} r(n)$$

$$\tilde{r}(n) = \begin{cases} r'(n), & \text{if } r'(n) > r_{th}, \\ 0, & \text{otherwise} \end{cases} \quad n = 0, 1, \ldots, N-1$$

wherein N denotes the size of a subframe. In these experiments, N is set to be 80, a difference r'(n), that is, a rectified signal, was obtained as shown in FIG. 4(*b*), and the peak-emphasized residual signal $\tilde{r}$(n), that is, a DC-removed and center-clipped signal, was obtained as shown in FIG. 4(*c*).

Then, the relative peak value calculation unit 310 calculates the peak value of a preprocessed residual signal, and obtains a relative peak value with respect to the peak value of the preprocessed residual signal using a predetermined reference peak value. A peak value $P_i$ at an i-th sample can be calculated by the following Equation 3:

$$P_i = \frac{\sqrt{\frac{1}{N}\sum_{N=0}^{N-1} |\tilde{r}(n+i-N+1)|^2}}{\frac{1}{N}\sum_{N=0}^{N-1} |\tilde{r}(n+i-N+1)|} \tag{3}$$

wherein $P_i$ denotes the peak value at an i-th sample, and N denotes the size of a subframe. Therefore, a signal having a peak value as shown in FIG. 4(*e*) was obtained.

In order to obtain the relative peak value, to be more specific, the difference between the peak value $P_i$ of the preprocessed residual signal at the i-th sample, and each of the previous peaks $P_{i-j}$ included in a predetermined period ($1 \leqq j < J$), is compared with a predetermined reference peak value. Thus, a determination as to whether the difference is greater than the predetermined reference peak value is made. If the difference is greater than the predetermined reference peak value, the counter is incremented by 1. If the counted coefficient is greater than a predetermined reference coefficient, a value of 1 is set, and otherwise, a value of 0 is set. A relative peak value $\tilde{P}_i$ expressed as a value of 1 or 0 is obtained through such a process, as shown in the following Equation 4:

$$\tilde{P}_i = \begin{cases} 1, & \text{if } \mathrm{Count}(P_i - P_{i-j} > P_{th}) > C_{th} \\ 0, & \text{otherwise} \end{cases}, \quad \text{for } 1 \le j < J \tag{4}$$

wherein $P_{th}$ denotes a reference peak value, $C_{th}$ denotes a reference coefficient, and J denotes the size of a predetermined signal period. In the experiment, 0. 42, 2 and 20 were set for $P_{th}$, $C_{th}$ and J, respectively.

Then, the transitional part detector 320 detects transitional parts, to be more accurate, the start position of each transitional part, using the relative peak value. That is, a subframe of a sample having a relative peak value of 1 obtained by Equation 4 is detected as a transitional part. Also, i in Equation 4 is the transitional part start position of a corresponding sub-frame. FIG. 4(*f*) shows detected transitional parts.

A method of synthesizing speech from the detected transitional parts will now be described. In harmonic speech coders, phase components must be estimated at each frame boundary. In a speech synthesis step according to the prior art, for stationary parts, zero-phase and random-phase applying methods are used for voiced and unvoiced bands, respectively, and likewise for transitional parts. On the assumption that a residual signal is a zero-phase signal, a h-th harmonic phase in voiced band at time (N) in the stationary part is estimated by the following Equation 5:

$$\theta_h^{v,s}(N) = \theta_h^{zero}(0) + \frac{hN}{2}(\omega_0(0) + \omega_0(N)), \; h = 1, 2, \ldots, H(N) \tag{5}$$

wherein $\omega_0(\theta)$, and $\omega_0(N)$ are the fundamental frequency at the previous frame and the current frame, respectively, and H(N) denotes the total number of harmonics in the current frame.

In the speech synthesis method according to the present invention, harmonics in which phase information is important are synthesized using a phase which is different from the phase shown in Equation 5. That is, it is preferable that transitional parts of speech such as an abrupt change period of speech or an onset period thereof are synthesized using the start position of each transitional part and the original phase at the start position. Phase components in the transitional region according to the present invention are estimated by the following Equation 6:

$$\theta_h^{v,i}(N) = \begin{cases} \theta_h^{zero}(0) + \frac{hN}{2}(\omega_0(0) + \omega_0(N)) \\ h\omega_0(N)\hat{i} + \Delta\hat{\theta}_h \end{cases} \quad (6)$$

wherein h is 1, 2, . . . , or H(N), H(N) denotes the total number of harmonics at a current frame, and $\hat{i}$, and $\Delta\hat{\theta}_h$ denote the start position of a transitional part and corrected phase information, respectively.

In the speech synthesis method according to the present invention, first, a determination is made as to which of the harmonics phase information will be allocated to. The standard of the determination and an allocation method are disclosed in Korean Patent No. 99-17505, entitled "Method and Apparatus for Synthesizing the Phases of Signals Using Auditory Characteristics", filed by the applicant of the present invention. According to the result of the determination, a phase obtained by the lower formula among two formulas in Equation 6 is allocated to the harmonic in which phase information is important. Here, the harmonic in which phase information is important may have the start position of each transitional part, $\hat{i}$, and the phase at the start position through the above-described process for detecting transitional parts.

Figure 5:
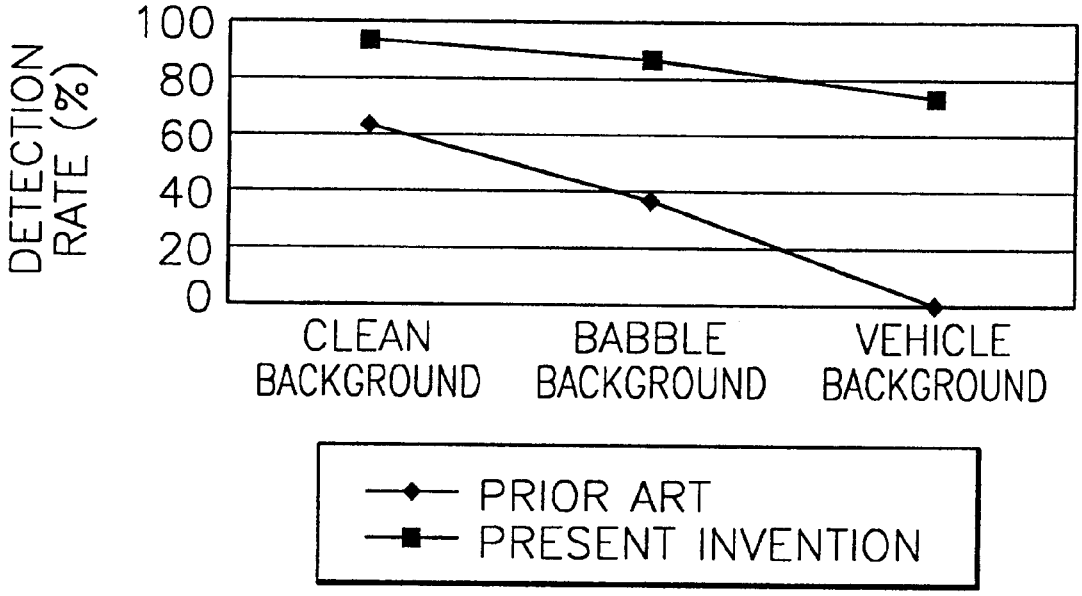
FIG. 5 is a graph showing an experiment in which the hit ratios according to the present invention and the prior art are compared with each other.

The following Table 1 shows results of an experiment according to transitional part detecting methods according to a conventional method and according to the present invention. FIG. 5 is a graph showing an experiment in which the hit ratios according to the present invention and the prior art are compared with each other, and FIG. 6 is a graph showing an experiment in which the false alarm rates according to the present invention and the prior art are compared with each other.

[TABLE 1]

| performance measurement | method | clean background | babble noise background | vehicle noise background |
|---|---|---|---|---|
| Hit ratio (%) | conventional method | 64.67 | 34.80 | 0.71 |
| | present invention | 92.94 | 85.78 | 71.43 |
| False alarm rate (%) | conventional method | 1.14 | 0.52 | 0.19 |
| | present invention | 0.11 | 0.14 | 0.00 |

Figure 6:
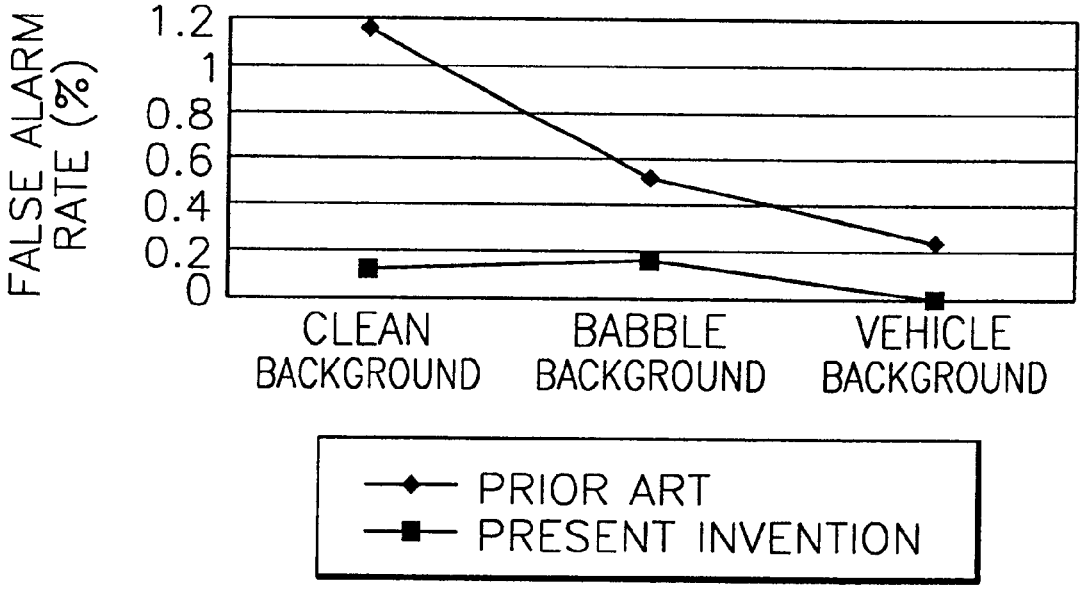
FIG. 6 is a graph showing an experiment in which the false alarm rates according to the present invention and the prior art are compared with each other.

Referring to Table 1 and FIGS. 5 and 6, it becomes evident that in the method of the present invention, the hit ratio of transitional parts is high in the clean background and the noise background, and the false alarm rate of transitional parts is significantly low, compared to the conventional method.

Meanwhile, the following Table 2 shows results of an experiment according to a speech synthesis method with respect to transitional parts. Likewise, referring to Table 2, it becomes evident that improved quality speech is reproduced in a clean background and a noisy background in the speech synthesis method according to the present invention than in a conventional speech synthesis method.

[TABLE 2]

| Test conditions | conventional method (%) | method according to the present invention (%) |
|---|---|---|
| speech in clean background | 25.52 | 31.25 |
| tandem | 26.04 | 39.06 |
| speech in babble noise background | 18.75 | 25.00 |

As described above, in an apparatus and method for detecting transitional parts of speech, and a method of synthesizing transitional parts of speech, according to the present invention, the detection rate of transitional parts of speech in a noisy background is improved, and detected transitional parts are effectively synthesized. Therefore, high quality speech at low bit rates is obtained.

The present invention has been described by way of exemplary embodiments to which it is not limited. Variations and modifications will occur to those skilled in the art without departing from the scope of the invention as set out in the following claims.

What is claimed is:

1. An apparatus for detecting transitional parts of speech, comprising:

a residual signal preprocessor for emphasizing a period of a speech residual signal which includes a peak value;

a relative peak value calculation unit for obtaining a peak value of a preprocessed residual signal and a relative peak value using a predetermined reference peak value; and a transitional part detector for detecting transitional parts of speech on the basis of the relative peak value.

2. The apparatus of claim 1, wherein the residual signal preprocessor emphasizes a period of a speech residual signal having a peak value by rectifying the residual signal, removing a DC component, and center-clipping the residual signal.

3. The apparatus of claim 2, wherein the peak-emphasized residual signal $\tilde{r}(n)$is calculated using the following Equation:

$$r'(n) = |r(n)| - \bar{r}, \quad n = 0, 1, \ldots, N-1$$

$$\bar{r} = \frac{1}{N}\sum_{n=0}^{N-1} r(n)$$

$$\tilde{r}(n) = \begin{cases} r'(n), & \text{if } r'(n) > r_{th}, \\ 0, & \text{otherwise} \end{cases} \quad n = 0, 1, \ldots, N-1$$

wherein $\bar{r}$ denotes the average of a residual signal, r'(n) denotes the difference between the absolute value of the residual signal and the average thereof, and N denotes the number of subframes.

4. The apparatus of claim 1, wherein the relative peak value calculation unit comprises:

a first peak value calculator for obtaining a peak value of a preprocessed residual signal;

a comparator for sequentially comparing the difference between the peak value of the preprocessed residual signal and each of the previous peak values included in a predetermined signal period, with a predetermined reference peak value;

a counter which increments by 1 whenever the difference is greater than the predetermined reference peak value; and a second peak value calculator for calculating a relative peak value expressed with first and second values by setting a peak value to the first value if a counted coefficient is greater than a predetermined reference coefficient, and otherwise, setting the peak value to the second value.

5. The apparatus of claim 4, wherein the peak value of the preprocessed residual signal is calculated using the following Equation:

$$P_i = \frac{\sqrt{\frac{1}{N}\sum_{N=0}^{N-1}|\tilde{r}(n+i-N+1)|^2}}{\frac{1}{N}\sum_{N=0}^{N-1}|\tilde{r}(n+i-N+1)|}$$

wherein $P_i$ denotes the peak value at an i-th sample, $\tilde{r}$(n)denotes a peak-emphasized residual signal, and N denote the size of a subframe.

6. The apparatus of claim 4, wherein the relative peak value is calculated using the following Equation:

$$\tilde{P}_i = \begin{cases} 1, & \text{if } \mathrm{Count}(P_i - P_{i-j} > P_{th}) > C_{th} \\ 0, & \text{otherwise} \end{cases}, \quad \text{for } 1 \le j < J$$

wherein $P_{th}$ denotes a reference peak value, $C_{th}$ denotes a reference coefficient, J denotes the length of a predetermined signal period, and i denotes the start position of a transitional part of a corresponding subframe.

7. A method of detecting transitional parts of speech, comprising:

(a) preprocessing a residual signal by emphasizing a period of a speech residual signal which includes a peak value;

(b) obtaining the peak value of a preprocessed residual signal;

(c) obtaining a relative peak value with respect to the peak signal of the preprocessed residual signal using a predetermined reference peak value; and (d) determining whether transitional parts exist or do not exist, on the basis of the relative peak value.

8. The method of claim 7, wherein the step (a) comprises:

(a1) obtaining the difference between the absolute value and average value of a residual signal; and (a2) obtaining a peak-emphasized residual signal by using the difference if the difference is greater than a predetermined reference value, and otherwise, setting the difference to a value of zero.

9. The method of claim 7, wherein the step (c) comprises:

(c1) sequentially comparing the difference between the peak value of the preprocessed residual signal and each of the previous peak values included in a predetermined signal period, with a predetermined reference peak value;

(c2) counting 1 whenever the difference is greater than the predetermined reference peak value; and (c3) obtaining a relative peak value expressed with first and second values by setting a peak value to the first value if a counted coefficient is greater than a predetermined reference coefficient, and otherwise, setting the peak value to the second value.

10. A method of synthesizing transitional parts of speech, comprising:

(a) determining which harmonic, among harmonic components of a pitch, phase information is to be allocated to, when speech is expressed in the frequency domain;

(b) allocating the start position of a transitional part and phase information obtained from a phase at the start position, to a harmonic to which phase information is important; and (c) synthesizing corresponding transitional parts using the allocated phase information.

11. The method of claim 10, wherein a phase expressed by the lower formula among two formulas in the following Equation is allocated to a harmonic to which the phase information is important, and a phase expressed by the upper formula is allocated to a harmonic to which the phase information is less important:

$$\theta_h^{v,i}(N) = \begin{cases} \theta_h^{zero}(0) + \frac{hN}{2}(\omega_0(0) + \omega_0(N)) \\ h\omega_0(N)\hat{i} + \Delta\hat{\theta}_h \end{cases}$$

wherein $\omega_0(\theta)$, and $\omega_0(N)$ denote the fundamental frequency of the previous frame and the fundamental frequency of the current frame, respectively, h is 1, 2, . . . , or H(N), H(N) denotes the total number of harmonics at the current frame, and $\hat{i}$, and $\Delta\hat{\theta}_h$ denote the start position of a transitional part and corrected phase information, respectively.

* * * * *